US010730709B2

(12) United States Patent
Lo et al.

(10) Patent No.: US 10,730,709 B2
(45) Date of Patent: Aug. 4, 2020

(54) MEDIA TRAY ASSEMBLIES WITH INDICATORS

(71) Applicant: Hewlett-Packard Development Company, L.P., Houston, TX (US)

(72) Inventors: Kevin Lo, Vancouver, WA (US); Wesley R Schalk, Camas, WA (US); Peter G Hwang, Vancouver, WA (US); Ki Jung Han, Vancouver, WA (US); Danny Barker, Vancouver, WA (US); Stephen G Brown, Vancouver, WA (US); Jeremy Barribeau, Portland, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 133 days.

(21) Appl. No.: 15/757,026

(22) PCT Filed: Sep. 11, 2015

(86) PCT No.: PCT/US2015/049736
§ 371 (c)(1),
(2) Date: Mar. 2, 2018

(87) PCT Pub. No.: WO2017/044125
PCT Pub. Date: Mar. 16, 2017

(65) Prior Publication Data

US 2019/0077620 A1 Mar. 14, 2019

(51) Int. Cl.
*B65H 1/14* (2006.01)
*B65H 1/04* (2006.01)
(Continued)

(52) U.S. Cl.
CPC ..... *B65H 1/14* (2013.01); *B41J 11/58* (2013.01); *B65H 1/04* (2013.01); *B65H 1/266* (2013.01);
(Continued)

(58) Field of Classification Search
CPC ... B65H 1/08; B65H 1/14; B65H 1/18; B65H 2511/152; B65H 2405/1117
See application file for complete search history.

(56) References Cited

U.S. PATENT DOCUMENTS 5,236,348 A 8/1993 Fetherolf et al.
5,692,231 A 11/1997 O et al.
(Continued)

FOREIGN PATENT DOCUMENTS

CN 101324765 12/2008
CN 103171916 6/2013
(Continued)

*Primary Examiner* — Howard J Sanders
(74) *Attorney, Agent, or Firm* — HP Inc. Patent Department

(57) ABSTRACT

In an example implementation, an example printer system includes a lift, an indicator, a trigger, and a reset mechanism. In an example implementation, a lift is orientable by an amount of media when adjacent to the lift and a trigger has a first portion engageable with the lift at a first orientation of the lift. In an example implementation, the trigger causes the indicator to move towards a first location relative to an aperture defined by an exterior surface in response to engagement with the lift. In an example, the reset mechanism has a first portion engageable with the lift at a second orientation of the lift and the reset mechanism causes movement of the indicator away from the first location in response to engagement with the lift.

20 Claims, 8 Drawing Sheets

(51) Int. Cl.

| | |
|---|---|
| ***B65H 7/00*** | (2006.01) |
| ***B65H 1/26*** | (2006.01) |
| ***B41J 11/58*** | (2006.01) |
| *B65H 7/04* | (2006.01) |

(52) U.S. Cl.

CPC ..... *B65H 7/00* (2013.01); *B65H 7/04* (2013.01); *B65H 2403/53* (2013.01); *B65H 2403/541* (2013.01); *B65H 2405/1117* (2013.01); *B65H 2511/152* (2013.01); *B65H 2511/214* (2013.01); *B65H 2511/30* (2013.01); *B65H 2551/23* (2013.01)

(56) References Cited

U.S. PATENT DOCUMENTS

| | | | | |
|---|---|---|---|---|
| 5,745,158 | A | 4/1998 | Lee | |
| 6,206,362 | B1 * | 3/2001 | Tan | B65H 7/04 271/145 |
| 6,252,654 | B1 | 6/2001 | Kaya | |
| 6,869,071 | B2 * | 3/2005 | Amamoto | B65H 1/12 271/145 |
| 7,025,346 | B1 | 4/2006 | Currans et al. | |
| 7,784,781 | B2 * | 8/2010 | Asada | B65H 1/266 271/145 |
| 8,393,613 | B2 | 3/2013 | Chen | |
| 8,684,347 | B2 | 4/2014 | Ito et al. | |
| 8,770,576 | B2 * | 7/2014 | Kimura | B65H 1/00 271/145 |
| 9,278,823 | B2 * | 3/2016 | Fujii | B65H 1/266 |
| 9,365,058 | B2 * | 6/2016 | Lo | B41J 11/58 |
| 9,857,748 | B2 * | 1/2018 | Koga | G03G 15/6511 |
| 2008/0143773 | A1 | 6/2008 | Chelvayohan et al. | |
| 2011/0103868 | A1 | 5/2011 | You | |
| 2013/0001871 | A1 | 1/2013 | Chen | |
| 2013/0161899 | A1 | 6/2013 | Ito et al. | |
| 2018/0257298 | A1 * | 9/2018 | Miles | B33Y 30/00 |

FOREIGN PATENT DOCUMENTS

| | | |
|---|---|---|
| CN | 104238742 | 12/2014 |
| JP | 61192579 | 8/1986 |
| JP | H06271141 | 9/1994 |
| JP | 07215529 | 8/1995 |
| JP | 200515235 | 1/2005 |
| JP | 2006103947 | 4/2006 |
| JP | 4819708 | 11/2011 |
| WO | WO-2014051556 | 4/2014 |

* cited by examiner

MEDIA TRAY ASSEMBLIES WITH INDICATORS

BACKGROUND

Media may be stored in a printer device, such as a within a media tray assembly of the printer device. Upon executing a job, media may be placed from a media tray onto a paper path to the print zone. The printer device may eject printing fluid onto the media in the print zone. The media may be ejected onto an output stack area.

DETAILED DESCRIPTION

In the following description and figures, some example implementations of media tray assemblies, printer systems, and/or methods of indicating a media status of a media tray assembly are described. A media tray assembly generally has a limit to the amount of paper that may be stored in the media tray area. For example, the media tray assembly may allow for 250, 500, or 800 pages of media to fit within the media tray area. As print jobs are executed by the printer system, the media is taken from the media tray area and used to complete the print jobs. In this manner, the number of pages left in the media tray reduces as the printer system executes print jobs. The media tray may need to be refilled in order to continue successful execution of print jobs. For example, the media tray assembly may empty of all paper in the media tray and the printer device may indicate an error describing a lack of paper rather than executing a print job. It is desirable for a user of a printer system to know when an amount of paper in the media tray assembly satisfies a low paper threshold.

Various examples described below relate to a mechanical system that uses a trigger to position an indicator based on an orientation of a lift of a media tray assembly and the indicator can indicate a media status, such as a low media status of the media tray assembly. By using a trigger that engages and disengages an indicator, an indicator may be placed adjacent to an aperture to allow a user to identify a media status of a media tray assembly.

The terms "include," "have," and variations thereof, as used herein, mean the same as the term "comprise" or appropriate variation thereof. Furthermore, the phrases "based on" and "in response to," as used herein, mean "based at least in part on" and "in response to at least in part." Thus, a feature that is described as based on some stimulus or in response to some stimulus may be based only on the stimulus or a combination of stimuli including the stimulus.

Figure 1:
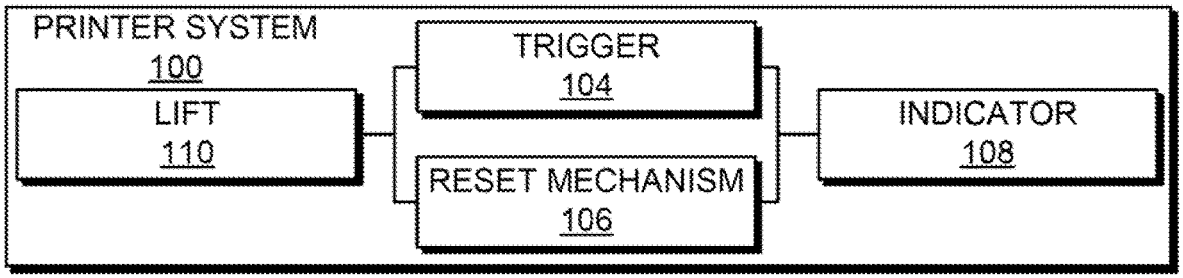
FIG. 1 is a block diagram depicting an example printer system.

FIG. 1 is a block diagrams depicting an example printer system 100. Referring to FIG. 1, the example printer system 100 of FIG. 1 generally includes a trigger 104, a reset mechanism 106, an indicator 108, and a lift 110. In general, the indicator 108 moves when the lift 110 interacts with the trigger 104 and/or the reset mechanism 106. For example, the indicator 108 may be an indicator plate that moves to cover an aperture in the exterior surface of the printer system 100. Referring to FIGS. 5 and 6, the printer system 100 includes a media tray assembly 102 that has an exterior surface defining an aperture 114. In the example of FIGS. 4-11, the aperture 114 formed by the exterior surface is a number. Other example apertures formed by an exterior surface are a geometric shape or a symbol, such as a symbol that uniquely identifies the tray assembly 102 from other tray assemblies of the printer system 100.

The lift 110 is orientable by an amount of media when the amount of media is adjacent to the lift 110. For example, the lift 110 can be a lift plate that sustains (e.g., holds) the amount of media and as the amount of media sustained by the lift plate increases the lift plate may move in a first direction and as the amount of media sustained by the lift plate may move in a second direction opposite of the first direction. As used herein, "media" refers to a printing material on which a printing fluid is ejectable. As examples, media may be paper (including uncoated or coated paper, such as photo paper), cardboard, transparencies, or other printing material, and printing fluid may be ink or toner.

The trigger 104 is a structure comprising a first portion engageable with the lift at a first orientation of the lift 110, and the reset mechanism 106 is a structure comprising a first portion engageable with the lift at a second orientation of the lift 110. As used herein, "a structure" includes a single unit or a combination of structures, such as a linkage or a rigid component having protrusions or other surface formations. The trigger 104 is able to cause movement of the indicator 108 towards a first location in response to engagement with the lift 110, and the reset mechanism 106 is able to cause movement of the indicator 108 away from the first location in response to engagement with the lift 110. In this manner, the indicator 108 is moved to a plurality of positions based on engagement by the lift 110 so that the orientation of the lift 110 is associated with the position of the indicator 108. For example, when the lift 110 is oriented in a position associated with a low amount of media, the indicator 108 is positioned in a location relative to an aperture, such as aperture 114, to indicate to a user that the media amount is low when the user observes the aperture.

Further description of structures and functionalities regarding a printer system 100 (e.g., structures useable as a trigger 104, a reset mechanism 106, an indicator 108, and a lift 110) are provided with regards to FIGS. 2, 3, and 4-11. In some examples, functionalities described herein in relation to any of FIGS. 1-3 may be provided in combination with functionalities described herein in relation to any of FIGS. 4-11.

Figure 2:
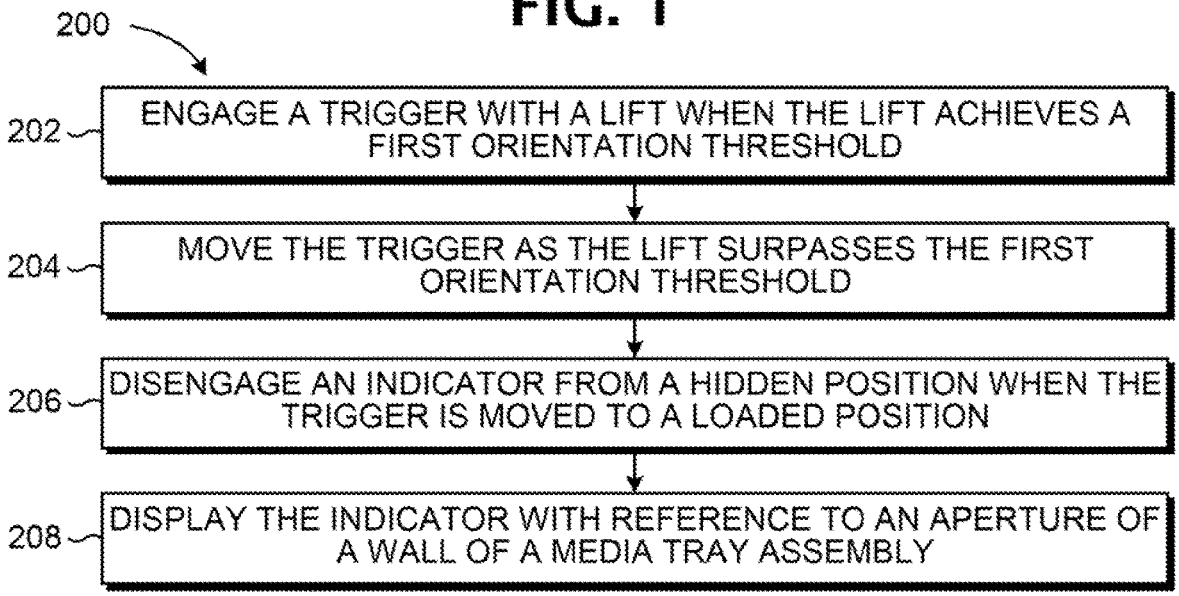
FIGS. 2 and 3 are flow diagrams depicting example methods of indicating a media status of a media tray assembly.
Figure 3:
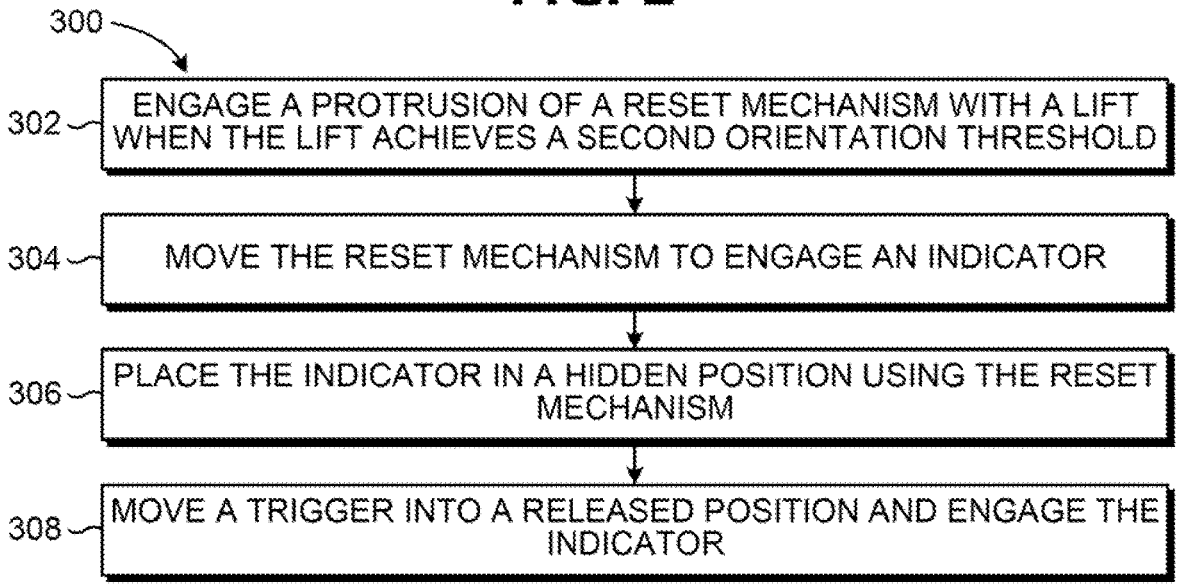

FIGS. 2 and 3 are flow diagrams depicting example methods of indicating a media status of a media tray assembly. Referring to FIG. 2, an example method 200 of indicating a media status of a media tray assembly may generally comprise engaging a trigger with a lift, moving the trigger, disengaging an indicator, and displaying the indicator with reference to an aperture.

At block 202, a trigger is engaged with a lift when the lift achieves a first orientation threshold. For example, a portion of the lift abuts a portion of the trigger (e.g., a beveled surface of the trigger) when the lift achieves a particular orientation. An orientation threshold, as used herein, refers to a particular orientation (e.g., position) of a plurality of possible orientations of the structure, such as a lift plate. For example, an orientation threshold may represent a particular position in a continuous range of movement of the lift. The trigger is moved as the lift surpasses the first orientation threshold at block 204. A threshold is surpassed in the example of a continuous range of movement when the structure moves to that position and then continues to further move (e.g., after making contact with another component described herein). For example, once the lift is in contact with the trigger in a released position, further movement of the lift towards the trigger may push against the trigger to slide the trigger towards a loaded position. In that example, a beveled surface (e.g., a beveled surface on the trigger and/or a beveled surface on the lift) may allow for the trigger to move in a direction with a component perpendicular to the direction of the lift. An indicator is disengaged with the trigger at block 206. For example, the indicator may be sustained by the trigger in a hidden position behind an exterior surface of the printer system and the indicator may disengage from contact with the trigger as the trigger moves to a loaded position. At block 208, the indicator may display with reference to an aperture of a wall of a media tray assembly. As used herein, the term "display" when used as a verb herein means to place an object within a frame of reference. For example, the indicator may be displayed by covering the aperture with the indicator (either partially or completely), placing the indicator behind the silhouette of the aperture, filling the aperture with the indicator, or otherwise making the indicator at least partially viewable via the aperture.

Referring to FIG. 6, the method 300 of indicating a media status of a media tray assembly may comprise engaging a reset mechanism, moving the reset mechanism to engage an indicator, place the indicator in a position using the reset mechanism, and moving the trigger into a released position.

At block 302, a protrusion of the reset mechanism is engaged with the lift when the lift achieves a second orientation threshold. The reset mechanism moves to engage the indicator at block 304. At block 306, the indicator is placed in a hidden position using the reset mechanism. The trigger is moved into a released position at block 308 where the released position of the trigger is in a position to engage the indicator. For example, the reset mechanism may push the trigger position out of the way of the indicator so that the trigger positions under the indicator to hold the indicator in place in the hidden position. In this manner, the trigger may sustain (e.g., hold up) the indicator in the hidden position when the reset mechanism moves to a rest position, such as position relative to the aperture.

By using the example methods 200 and 300, the indicator is placeable in positions to indicate the status of media associated with the lift. For example, the methods 200 and 300 may be used to position the indicator in a first position hidden within the media tray assembly when the lift is about filled with media (or otherwise achieves a media amount threshold associated with an adequate amount of media) and used to position the indicator in a second position when the lift is running low on media or empty of media (or otherwise achieves a media amount threshold associated with an inadequate or recommendable amount of media). In this manner, the indicator 108 is usable as an identifier of a media status, such as two-state mechanical identifier to indicate whether media should be added to the media tray based on a height threshold of the lift 110, where the height of the lift 110 is based on the amount of media adjacent to the lift 110 (e.g., the amount of media on top of the lift 110). By using a mechanical system (e.g., without electricity required) as described herein, the indicator may, for example, properly indicate the media status even when the printer is powered off.

Figure 4:
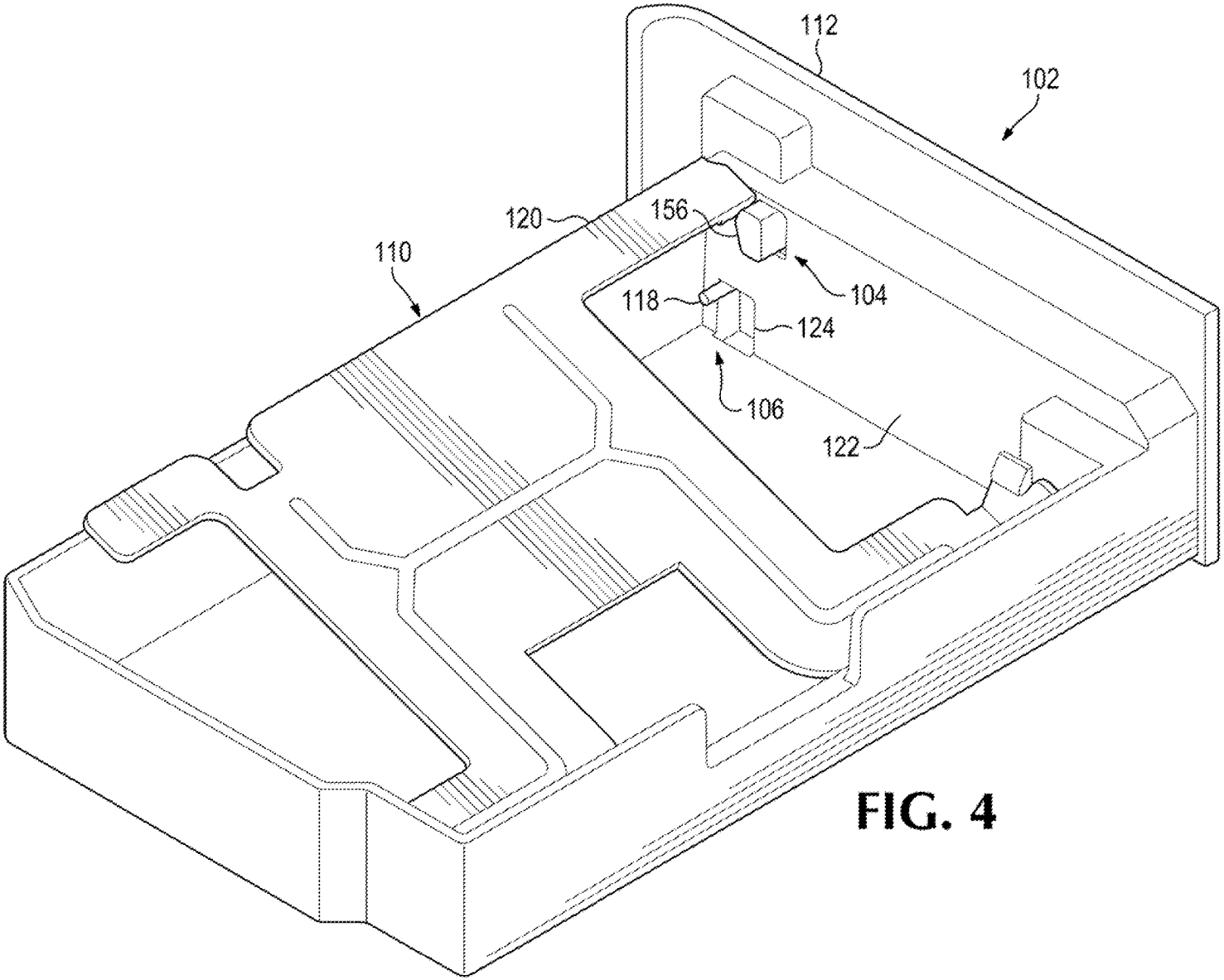
FIGS. 4-7 are perspective views of an example media tray assembly.
Figure 5:
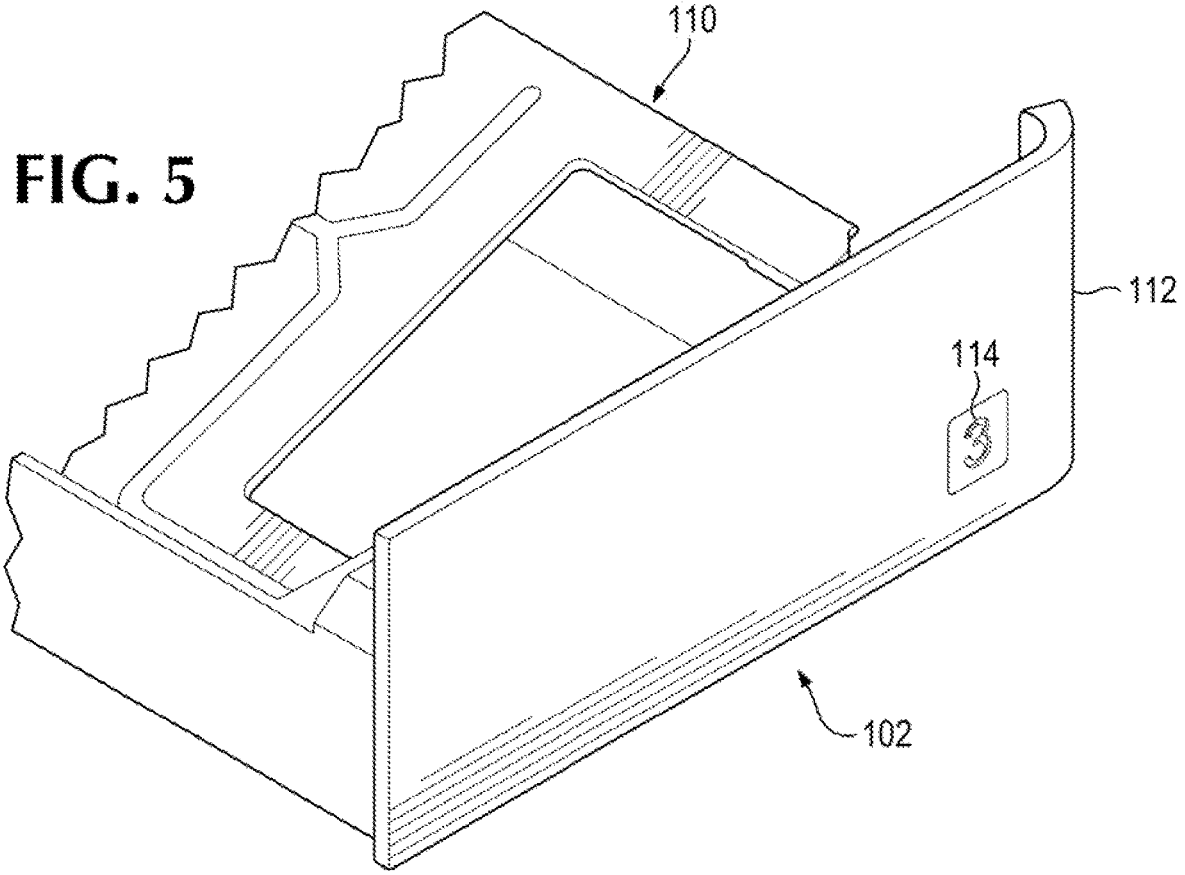
Figure 6:
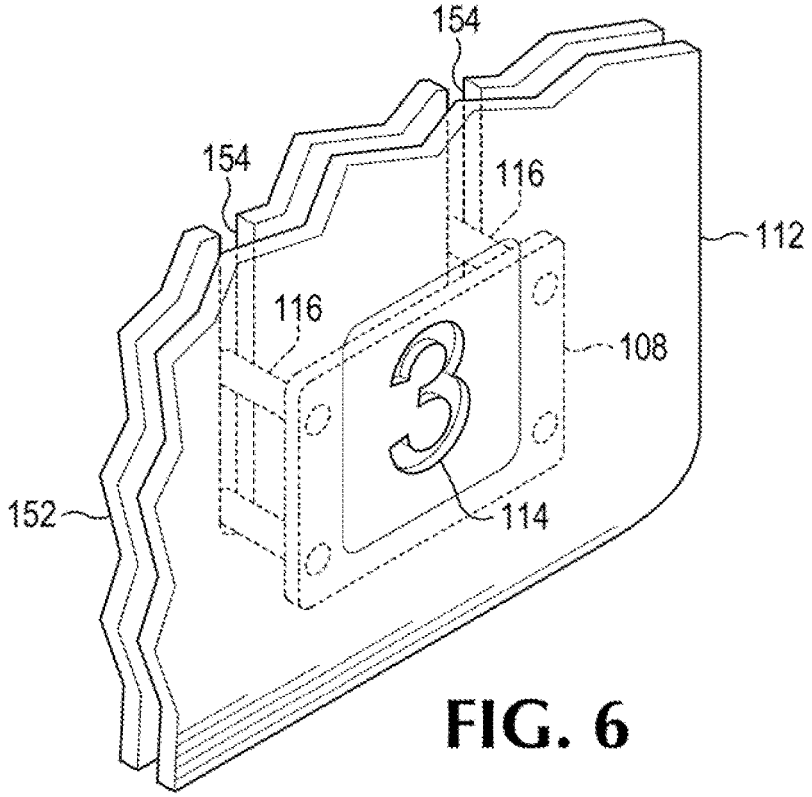

FIGS. 4-7 are perspective views of an example media tray assembly. Referring to FIG. 4, an example media tray assembly 102 is depicted in a low media state (e.g., low paper state) associated with a first orientation of the lift 110. The lift 110 comprises an extension 120 that moves in a first direction with a vertical component as the lift 110 rotates about a first end of the lift 110, such as end 164 that rotates about joint 166 of FIG. 8. When the lift 110 is oriented in the first orientation, movement of the lift 110 causes the extension 120 to move the trigger 104 in a second direction with a horizontal component. The second direction may be oblique or orthogonal to the direction of the lift 110. For example, the vertical movement of the extension 120 may be translated into horizontal movement of the trigger 104 by contacting a beveled surface 156 formed by a portion of the trigger 104. In that example, the movement of the lift 110 against the beveled surface causes the trigger 104 to at least one of rotate or move linearly. The movement of the trigger 104 (e.g., rotational motion and/or linear motion of the trigger) causes the trigger 104 to disengage from the indicator 108. In the example depicted in FIG. 4, the indicator 108 falls using gravitational force. In other examples, the indicator 108 may be moved using spring forces, gear forces, or other similar forces as caused by the trigger 104.

Figure 7:
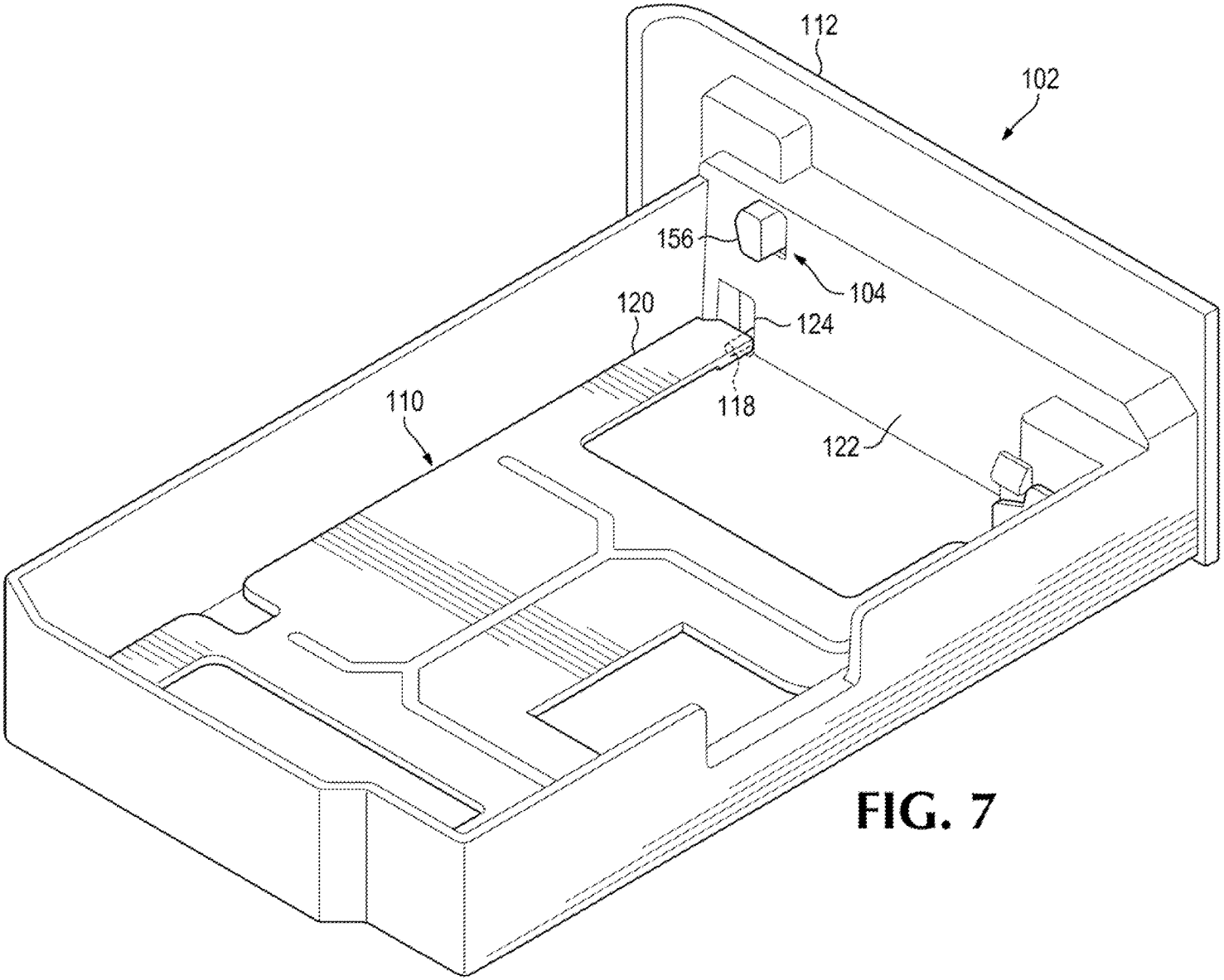

The indicator 108 may stay in a position until a reset mechanism 106 causes the indicator 108 to move from the location placed in by the trigger 104. Referring to FIG. 7, a second orientation of the lift 110 contacts a portion of the reset mechanism that forms a protrusion 118 and activates the reset mechanism 106 to move the indicator 108. As shown in FIG. 7, an interior surface 122 of the media tray assembly 102 forms a slot 124 that accepts the protrusion 118. The dimension of the slot 124 defined by a portion of the interior surface 122 allows for the reset mechanism 106 to actuate in relation to the positions of the protrusion 118 as moved by the lift 110.

Referring to FIGS. 5 and 6, the media tray assembly 102 comprises an exterior surface 112 that defines an aperture 114. As depicted in FIGS. 5 and 6, the aperture 114 formed by a portion of the exterior surface 112 is a symbol silhouetteable by the indicator 108. For example, part of the indicator 108 may be viewable through the aperture 114 (e.g., the indicator 108 is placed behind the aperture 114). Viewability of the indicator 108 may be enhanced by the indicator 108 having a contrasting color, such as a color in contrast to the color of the exterior surface. The indicator 108 depicted in FIG. 6 has a protrusion 116 and the media tray assembly 102 may include a surface 152 that defines a channel 154 where the protrusion 116 fits within the channel 154 and the channel 154 guides movement of the indicator 108. As used herein, a "protrusion" represents a portion of a structure that projects or protrudes from the structure. Example protrusions include projections, bulges, pegs (e.g., round pegs or square pegs), a tab or other flat or finned surface, or other extensions beyond the main body.

Figure 8:
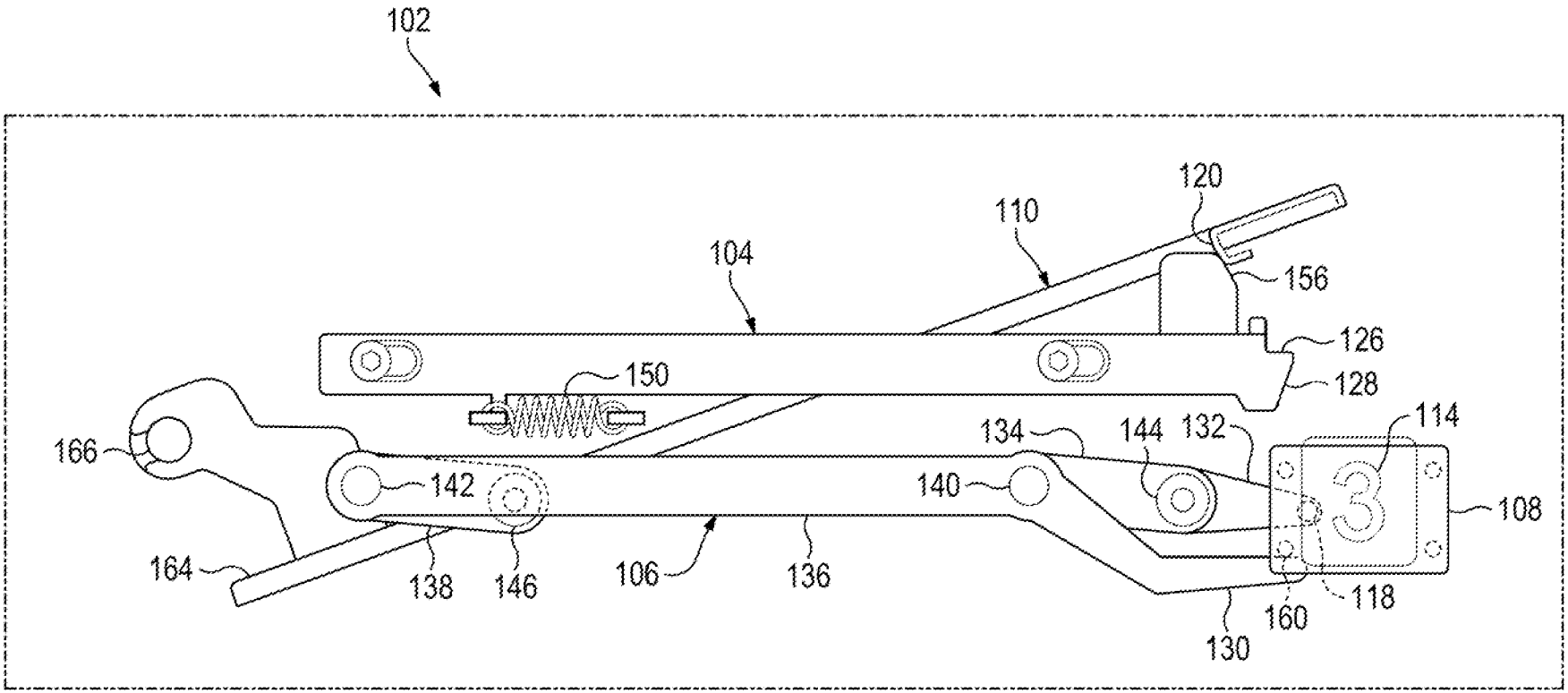
FIGS. 8-11 are side views of an example media tray assembly.
Figure 9:
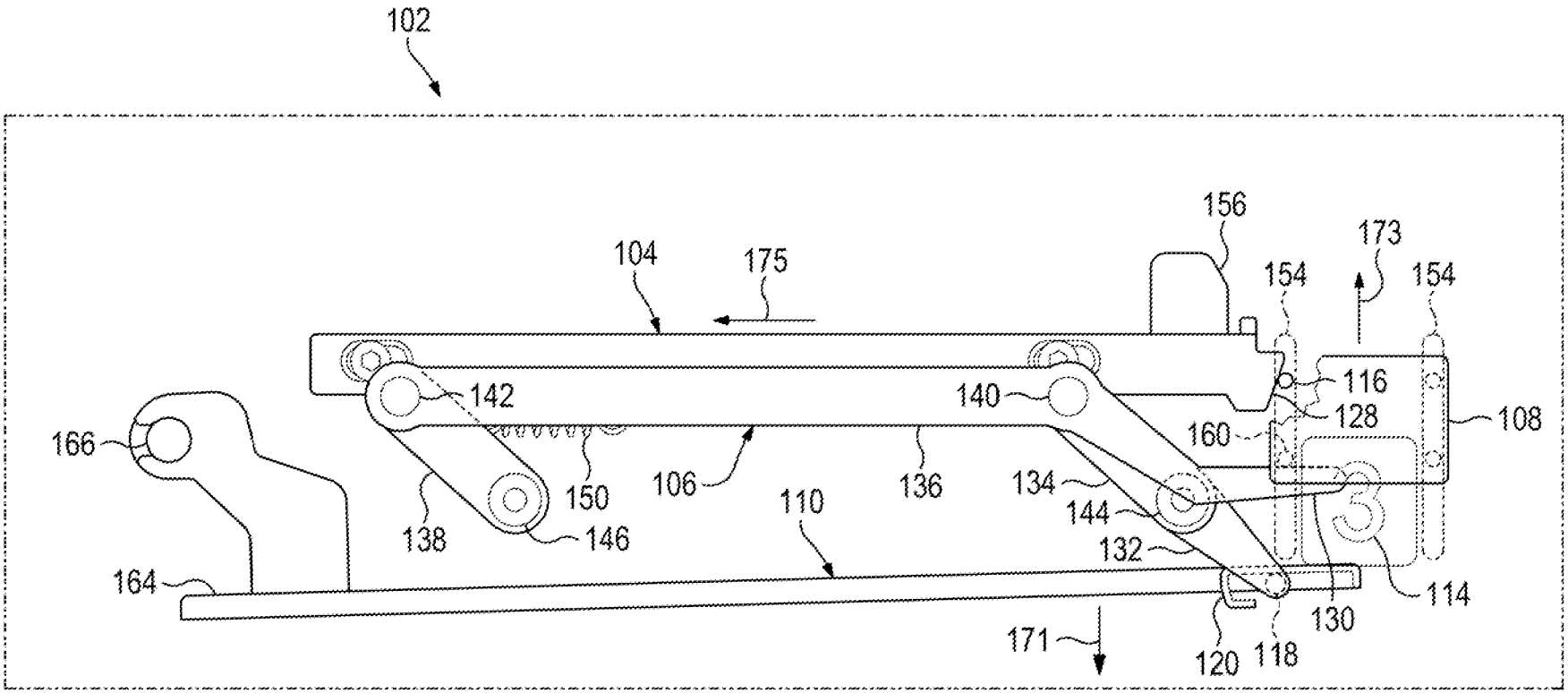

FIGS. 8-11 are side views of an example media tray assembly 102. Referring to FIG. 8, the indicator 108 is depicted in a state displayed with reference to the aperture 114 (e.g., the indicator 108 is displayed through the aperture 114). The indicator 108 of FIG. 8 has a protrusion 160 that is engageable with the reset mechanism 106. The portion of the reset mechanism 106 is able to sustain the indicator or otherwise cause the indicator 108 to move, such as along a channel, based on movement of the lift 110. The reset mechanism 106 is to engage the indicator 108 with a first portion of the reset mechanism 106 in response to engagement of the lift 110 with a second portion of the reset mechanism 106. For example, the arm 130 is to move in an opposite vertical direction of the portion of the reset mechanism that forms the protrusion 118 as the lift 110 engages with the protrusion 118 as depicted in FIG. 9.

The reset mechanism 106 may be a linkage, such as a multi-bar linkage, comprising a plurality of links and joints. For example, a first portion of the reset mechanism 106 may be operatively coupled to a second portion of the reset mechanism 106 by a joint that allows the indicator to move past a second portion of the trigger as the first portion of the reset mechanism moves below a height threshold associated with an orientation of a lift 110. The thresholds discussed herein, such as orientation thresholds or height thresholds, may include an orientation associated with a low media height threshold and/or an orientation associated with a recommended media height threshold.

Figure 10:
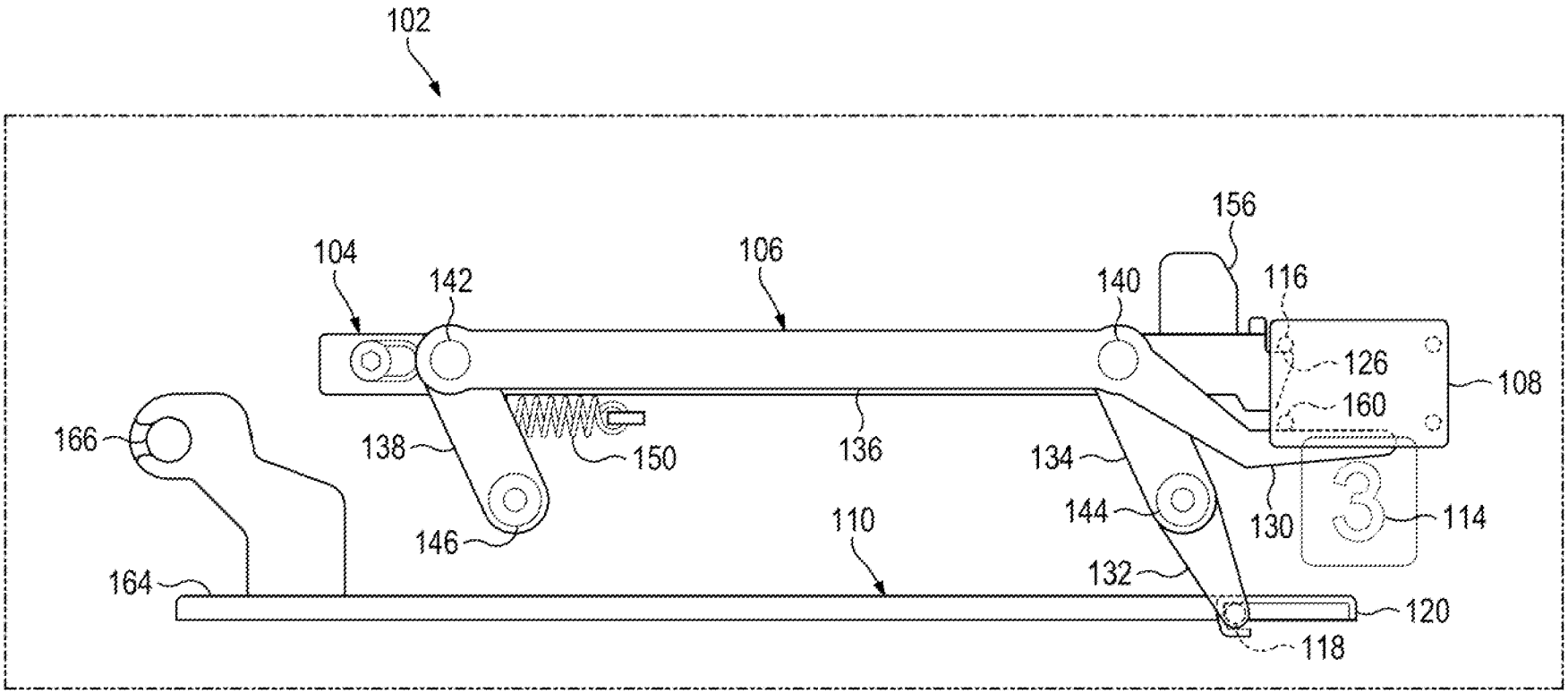

The reset mechanism 106 depicted in FIGS. 8-10 is a linkage comprising a first link 136, a second link 134, a third link 138, a first joint 140, a second joint 142, a third joint 144, and a fourth joint 146. As depicted in FIGS. 8-10, the links 134 and 138 move in parallel so that the link 136 moves up or down based on the movement of protrusion 118. The joints 144 and 146 allow for the links 134 and 138 to rotate and allows the ends of the links 134 and 138 at joints 142 and 140 to move. In this manner, the link 136 moves vertically and the arm 130 of the link 136 engages the indicator 108 and moves the indicator 108 away from the aperture 114 as the link 134 rotates.

The trigger 104 has a structure with a first portion that forms a lip 126, a second portion that forms a beveled or angular surface 128, and a third portion that forms a second beveled or angular surface 156. The trigger 104 is coupled to or otherwise includes a biasing member 150. The biasing member 150 is able to provide a force in a direction oblique to the surfaces 128 and 156. In this manner, the biasing member allows for the trigger 104 to be placed in a loaded position and, when forces are removed, return to a released position. For example, the trigger 104 is moved by the extension 120 when in contact with angular surface 156 or by the protrusion 116 of the indicator 108 when in contact with the angular surface 128 as depicted in FIG. 9.

Referring to FIG. 9, the media tray assembly 102 includes a first surface defining an aperture 114, a second surface defining a channel 154 with an end of the channel 154 oriented towards the aperture 114, an indicator 108 having a first protrusion and a second protrusion (e.g., pegs 116 and 160), a trigger 104, and a lift 110. The first surface 128 formed by a first portion of the trigger 104 may be angular to the lip 126 formed by a second portion of the trigger 104 and a biasing member 150 may provide a force in a direction oblique to the angle of the first surface 128. The pegs 116 and 160 may be spaced apart an amount that fits the width of the trigger 104 (e.g., the vertical distance of the angular surface 128) between the pegs. In the example, of FIG. 9, the force of biasing member 150 is in the opposite direction of the force 175. The lift 110 has a portion that is engageable with the first surface 128 of the trigger 104 when the lift 110 moves from a first position to a second position and moves the trigger 104 past the channel 154 in an opposing direction of the force of the biasing member 150, which causes the trigger 104 to disengage the peg 116 when the trigger 104 moves past the channel 154 in the direction of force 175 and engage the peg 116 when the trigger 104 moves in a direction opposite to force 175. For example, the lift 110 is depicted as moving in the direction of force 171 and the extension 120 engages the reset mechanism 106 at protrusion 118 extending from extension 132 to rotate the link 134 move the indicator 106 through the channel 154 in the direction of force 173 as the link 136 moves. In that example, the protrusion 116 contacts and moves the trigger 104 at the angular surface 128 and pushes the trigger 104 in the direction of force 175.

The reset mechanism 106 of FIG. 9 comprises a joint 140, a first link 134 coupled to the joint 140, and a second link 136 coupled to the joint 140. The first link 134 includes a first member 132 extending from the joint 140 and a protrusion 118 extending from the first member 132 of the first link 134 (which extends into the media tray area as depicted in FIGS. 4 and 7). The second link 136 comprises an arm 130 extending from the joint 140 and the arm 130 is formed to be engageable with the indicator 108.

A portion of the lift 110 forming an extension 120 is oriented towards the media tray wall (e.g. interior wall 122 of FIG. 4) where the media tray wall has a third surface defining a slot, such as slot 124 of FIG. 4, that accepts the protrusion 118 of the first link 134 of the reset mechanism 106 into the media tray area and the extension 120 is engageable with the protrusion 118 when the lift is in a position associated with an orientation of the lift 110 that achieves a recommended (or low) media threshold. In one example, the lift 110 may have at least two orientations to allow the lift 110 to engage with the trigger 104 and to allow the lift 110 to engage the reset mechanism 106. In another example, the lift may have at least four orientations including the orientations in the above example and orientations that allow the lift to push against the trigger 104 to cause the indicator 108 to move and allow the lift 110 to push against the reset mechanism 106 to lift the indicator 108 using an arm 130. The orientations discussed herein may be example states of the lift 110 across a continuous range of movement of the lift 110. The arm 130 is engageable with a second peg 160 of the indicator 108 so that the reset mechanism 106 moves the arm 130 away from the aperture 114 as the peg 160 moves from a first position in the channel 154 to a second position in the channel 154.

Referring to FIG. 10, the trigger 104 has a portion that sustains the indicator 108 at a location that is different from the location of the aperture 114 (e.g., a portion of the trigger 104 forms a lip 126 that sustains the protrusion 116 of the indicator 108 in a position that is not displayed with reference to the aperture 114). The trigger 104 changes from a loaded position to a released position once the peg 116 surpasses the position of the lip 126 of the trigger 104. In this manner, the biasing member 150 applies force on the trigger 104 to cause the trigger 104 to engage the indicator 108 at the peg 116 (e.g., move under the peg 116 to hold the indicator 108 at the position at the height of the trigger 104. As media is removed from the media tray assembly 102, the lift 110 rotates with the extension 120 moving upwards and the indicator 108 stays sustained in the position by the trigger 104 until the lift 110 rotates and surpasses an orientation of the lift 110 that engages with the trigger 104 to release the indicator 108 towards the location of the aperture 114. The reset mechanism 106 is positioned in a catch position (as depicted in FIG. 8) as the protrusion 118 moves in conjunction with removal of media from the media tray area.

Figure 11:
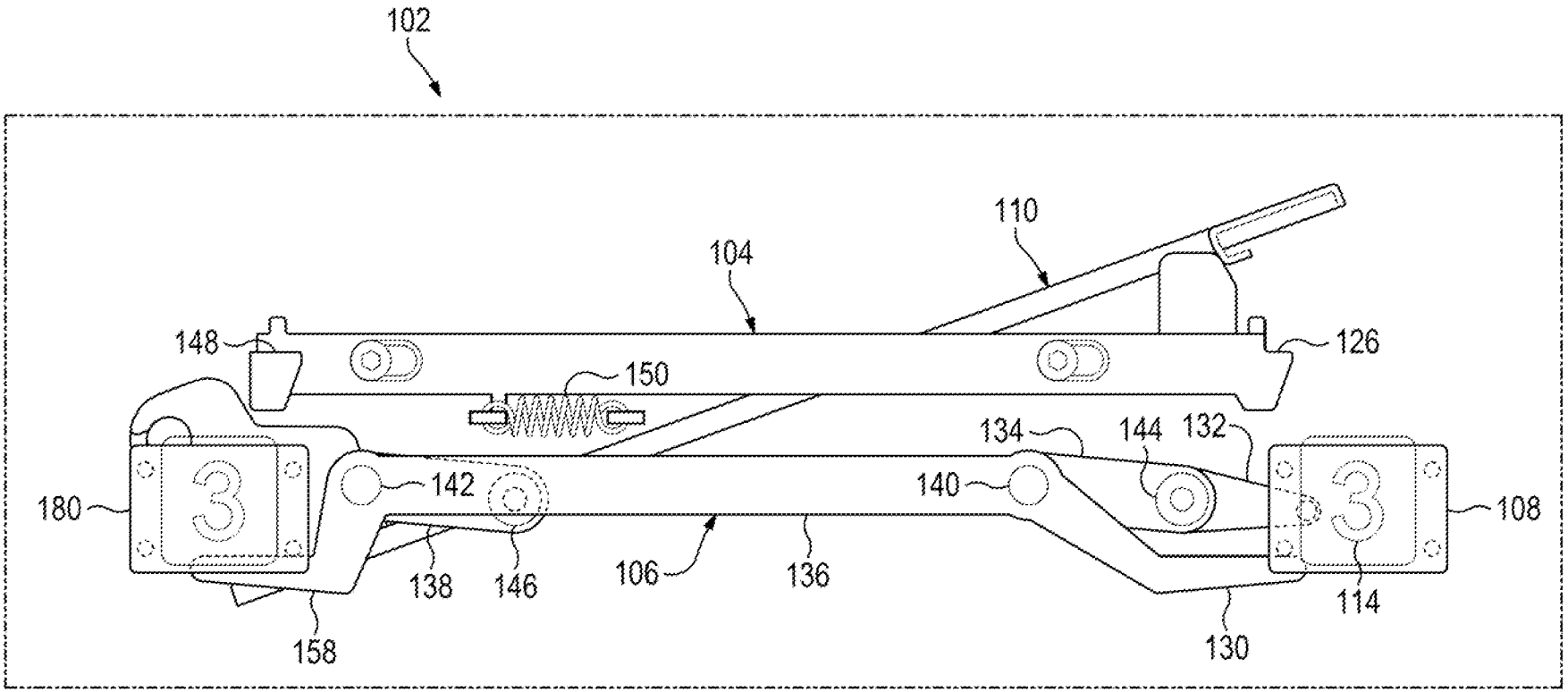

Referring to FIG. 11, the reset mechanism may be a multi-bar linkage that moves two indicators. For example, the reset mechanism may include a first arm 130 and a second arm 158 capable of engaging protrusions from a first indicator 108 and a second indicator 180 respectively. The trigger 104 of FIG. 11 has a structure that forms a first portion and a second portion (e.g., a first lip 126 and a second lip 148), wherein the first portion 126 of the trigger and the second portion 148 of the trigger sustain the two indicators 108 and 180 until the lift 110 achieves a second height threshold associated with the first orientation of the lift 110. For example, both indicators 108 and 180 are dropped when the lift 110 achieves an orientation associated with a low media height threshold. For another example, both indicators 108 and 180 are lifted by the reset mechanism 106 when the lift achieves an orientation that satisfies a height threshold associated with a recommended amount of media (e.g., the media tray is sufficiently filled with paper). In this manner, an indicator is able to be positioned (e.g., moved to be displayed or hidden) on either a left side of the media tray assembly and/or a right side of the media tray assembly without, for example, a modification to the design of the lift. For example, a media tray assembly, such as media tray assembly 102 as described herein, may have a lift with an extension on the right side that can drive an indicator on either the left side or the right side of the media tray assembly (e.g., use the same trigger and reset mechanism configuration to position an indicator on the left side of the media tray assembly as would be used to position an indicator on the right side of the media tray assembly).

Although the flow diagrams of FIGS. 2-3 illustrate specific orders of execution, the order of execution may differ from that which is illustrated. For example, the order of execution of the blocks may be scrambled relative to the order shown. Also, the blocks shown in succession may be executed concurrently or with partial concurrence. All such variations are within the scope of the present description.

All of the features disclosed in this specification (including any accompanying claims, abstract and drawings), and/or all of the elements of any method or process so disclosed, may be combined in any combination, except combinations where at least some of such features and/or elements are mutually exclusive.

The present description has been shown and described with reference to the foregoing examples. It is understood, however, that other forms, details, and examples may be made without departing from the spirit and scope of the following claims. The use of the words "first," "second," or related terms in the claims are not used to limit the claim elements to an order or location, but are merely used to distinguish separate claim elements.

What is claimed is:

1. A printer system comprising:

an exterior surface defining an aperture associated with a media tray assembly;

a lift;

an indicator;

a trigger having:

a first portion engageable with the lift at a first orientation of the lift; and a second portion engageable with the indicator at a second orientation of the lift, the second portion of the trigger to sustain the indicator at a first location relative to the aperture until the first portion of the trigger engages with the lift; and a reset mechanism having:

a first portion engageable with the lift at a third orientation of the lift; and a second portion operably coupled to the first portion such that the second portion moves inversely with respect to the first portion, the second portion engageable with the indicator to sustain the indicator as the second portion of the reset mechanism moves towards the first location while the first portion of the reset mechanism moves away from the first location in response to engagement with the lift.

2. The system of claim 1, wherein:

the indicator has a protrusion; and the second portion of the trigger forms a lip that sustains the protrusion of the indicator.

3. The system of claim 2, wherein the indicator includes a peg spaced apart from the protrusion, the second portion of the reset mechanism being an arm operable to sustain the indicator at the peg.

4. The system of claim 3, wherein:

the arm is engageable with the peg of the indicator so that the reset mechanism moves the arm away from the aperture as the peg moves from a first position in the channel to a second position in the channel, and the lift rotates, as media is removed from the media tray assembly, with the extension moving upwards and the indicator stays sustained in the position by the trigger until the lift rotates and surpasses an orientation of the lift that engages with the trigger to release the indicator towards the location of the aperture.

5. The system of claim 1, wherein:

the first portion of the trigger forms a beveled surface; and the movement of the lift against the beveled surface causes the trigger to at least one of rotate or move linearly.

6. The system of claim 1, wherein:

the lift comprises an extension that moves in a first direction with a vertical component as the lift rotates about a first end of the lift; and the lift, when positioned in the first orientation, causes the extension to move the trigger in a second direction with a horizontal component and disengage from the indicator.

7. The system of claim 1, wherein:

the indicator has a first color in contrast to a second color of the exterior surface; and the aperture formed is a symbol silhouetteable by the indicator.

8. The system of claim 1, wherein:

the second portion of the reset mechanism to move in an opposite vertical direction of the first portion of the reset mechanism; and the reset mechanism to engage the indicator with the second portion of the reset mechanism in response to engagement of the lift with the first portion of the reset mechanism.

9. The system of claim 8, wherein:

the first portion of the reset mechanism is operatively coupled to the second portion of the reset mechanism by a joint that allows the indicator to move past a second portion of the trigger as the first portion of the reset mechanism moves below a first height threshold associated with the second orientation of the lift, the second portion of the trigger forming a lip.

10. The system of claim 9, wherein:

the reset mechanism is a multi-bar linkage that moves two indicators; and the trigger has a third portion, wherein the second portion of the trigger and the third portion of the trigger sustain the two indicators until the lift achieves a second height threshold associated with the first orientation of the lift.

11. The system of claim 1, wherein:

the indicator is capable of moving to a plurality of positions based on engagement with the lift and an orientation threshold of the lift, the orientation threshold representing a position of the lift in a continuous range of movement of the lift.

12. The system of claim 1, wherein the indicator is a two-state mechanical indicator such that, during operation of the media tray assembly, the indicator moves, via a channel of an interior surface, between a second location behind the exterior surface and within a frame of reference of the aperture and the first location behind the exterior surface and out of a frame of reference of the aperture.

13. A media tray assembly comprising:

a first surface defining an aperture;

a second surface defining a channel, an end of the channel oriented towards the aperture;

an indicator having a first peg located within the channel;

a trigger comprising:

a lip capable of sustaining the first pen of the indicator when the lip is positioned across the channel;

a first surface angular to the lip; and a biasing member, the biasing member to provide force in a direction oblique to the first surface; and a lift having a portion that engages the first surface of the trigger when the lift moves from a first position to a second position and moves the trigger past the channel in an opposing direction of the force, the first peg to disengage from the lip when the trigger moves the lip past the channel in which the first peg is contained in response to engagement of the lift with the first surface of the trigger.

14. The media tray assembly of claim 13, further comprising:

a reset mechanism comprising:

a joint;

a first link coupled to the joint, the first link comprising:

a first member extending from the joint of the reset mechanism; and a protrusion extending from the first member of the first link into a media tray area; and a second link coupled to the joint, the second link comprising:

an arm extending from the joint, the arm engageable with the indicator.

15. The media tray assembly of claim 14, wherein:

the portion of the lift is an extension towards a media tray wall, the media tray wall having a third surface defining a slot that accepts the protrusion of the first link into the media tray area and the extension engageable with the protrusion when the lift is in a third position;

the arm is engageable with a second peg of the indicator; and the reset mechanism moves the arm away from the aperture as the protrusion moves from a first position to a second position.

16. The media tray assembly of claim 15, wherein:

the trigger includes a second lip that sustains a second indicator;

the reset mechanism is a bar linkage;

the second link further comprises a second arm;

the arm is engageable with the first indicator; and the second arm is engageable with the second indicator.

17. The media tray assembly of claim 14, wherein the first link and the second link move in conjunction with each other so that the second link moves up or down based on the movement of protrusion.

18. A method of indicating a media status of a media tray assembly comprising:

engaging a trigger with a lift when the lift achieves a first orientation threshold;

moving, via the lift, the trigger as the lift surpasses the first orientation threshold;

releasing an indicator from a first position sustained by the trigger into a channel directed towards an aperture in a wall of the media tray when the trigger is moved to a loaded position; and displaying the indicator with reference to the aperture of the wall of the media tray assembly.

19. The method of claim 18, wherein:

engaging a protrusion of a reset mechanism with the lift when the lift achieves a second orientation threshold;

moving, in conjunction with movement of the lift, the reset mechanism to engage the indicator;

placing, via the reset mechanism, the indicator in the first position; and moving, via a bias member, the trigger into a released position, the trigger to engage the indicator when in the released position.

20. The method of claim 18, wherein the first position of the indicator is located behind an exterior surface of the media tray assembly and out of a frame of reference of the aperture.

* * * * *